US007363969B2

(12) United States Patent
Muderlak et al.

(10) Patent No.: US 7,363,969 B2
(45) Date of Patent: Apr. 29, 2008

(54) CASING VENT SECURITY DEVICE

(75) Inventors: Kenneth Muderlak, Milwaukee, WI (US); Todd J. Muderlak, Milwaukee, WI (US)

(73) Assignee: Xela Innovations, LLC, Milwaukee, WI (US)

( * ) Notice: Subject to any disclaimer, the term of this patent is extended or adjusted under 35 U.S.C. 154(b) by 261 days.

(21) Appl. No.: 10/910,175

(22) Filed: Aug. 2, 2004

(65) Prior Publication Data

US 2005/0167102 A1 Aug. 4, 2005

Related U.S. Application Data

(60) Provisional application No. 60/540,246, filed on Jan. 29, 2004.

(51) Int. Cl.
*E21B 34/02* (2006.01)

(52) U.S. Cl. ..... 166/97.1; 166/75.13; 166/250.01

(58) Field of Classification Search ..... 166/250.15, 166/75.11, 75.13, 97.1, 250.01; 454/275
See application file for complete search history.

(56) References Cited

U.S. PATENT DOCUMENTS

| | | | | |
|---|---|---|---|---|
| 2,793,699 A | | 5/1957 | Tubbs | 166/75 |
| 4,411,312 A | | 10/1983 | English | 166/75 |
| 4,562,888 A | * | 1/1986 | Collet | 166/97.1 |
| 4,972,905 A | | 11/1990 | Henson | 166/92 |
| 5,289,882 A | | 3/1994 | Moore | 166/379 |
| 5,823,259 A | | 10/1998 | Royle | 166/97.1 |
| 6,502,632 B1 | | 1/2003 | Pittman | 166/75.13 |
| 6,595,277 B2 | | 7/2003 | Zins et al. | 166/75.13 |
| 6,684,945 B1 | | 2/2004 | Meyers | 166/75.13 |
| 6,805,627 B2 | | 10/2004 | Marts et al. | |
| 7,169,039 B2 | * | 1/2007 | Oppedisano et al. | 454/256 |
| 2003/0010726 A1 | * | 1/2003 | Zins et al. | 210/767 |

OTHER PUBLICATIONS

Omega Ven Security Shroud, Arc Corporation, www.arctheree.com, 2001.

* cited by examiner

*Primary Examiner*—Giovanna C Wright
(74) *Attorney, Agent, or Firm*—Whyte Hirschboeck Dudek SC

(57) ABSTRACT

A casing vent security device includes an in-line section in communication with a casing vent, the in-line section having an ambient air passageway for selectively allowing ambient air to pass through the in-line section and into the vent. The device further includes a plurality of sensors disposed within the in-line section for monitoring the ambient air passing through the in-line section. The device still further includes at least one mechanism for selectively occluding the passage of ambient air into the vent upon receiving a signal from the sensors. The device provides information on the plurality of sensors and the vent.

10 Claims, 9 Drawing Sheets

CASING VENT SECURITY DEVICE

CROSS REFERENCE TO RELATED APPLICATION

This application claims the benefit under 35 USC §119(e) of U.S. Provisional Application No. 60/540,246 filed Jan. 29, 2004, which is incorporated herein by reference.

BACKGROUND OF THE INVENTION

Wells accessing water from the Earth's aquifers are used for both drinking water and agricultural purposes across the country and indeed, the world. A typical water well is established by first drilling a hole in the ground in search of water from a water-bearing aquifer. Once water is reached by the drill, a well casing is inserted into the bore hole to preserve the sides of the well. The well casing is typically a steel or plastic pipe installed while drilling the well to prevent collapse of the well bore hole.

A vent pipe (casing vent) is typically used on virtually all wells. The primary purpose of the casing vent is to prevent undesirable vacuum formation within the well, which is caused by the drawing of air into the well. The casing vent also allows gases to escape from the wells because of the contact of the casing vent with the surrounding air. The casing vent serves as an access point to the aquifer itself, and this can be used to test and/or measure water level and quality.

It is necessary for the casing vent to have a weather head that is protective in nature. Typically this protective weather head takes on a "T" or inverted "L" shape. The weather head usually includes an open end which is typically covered by a coarse screen material, with the screen typically being secured by a plurality of clamps (e.g., hose clamps).

One significant problem associated with current casing vents is that the vent casings are easily infiltrated or penetrated by contaminants, which can take a variety of forms (nuclear, chemical, biological) and can take on any physical state, whether gas, liquid, or solid. Any contaminants entering the casing vents would potentially come into contact with the water in the aquifer. Therefore, any infiltration to the system poses a system disruption and contamination risk.

As such, it would be desirable to provide a casing vent security device that can prevent an intruder from placing contaminates into aquifer water via the casing vent. It would be desirable to provide a casing vent security device that provides the desired security without sacrificing the required airflow reaching the casing vent (that is, maintaining the airflow as it would be without the casing vent security device). It would be desirable to provide a casing vent security device that can prevent the individual person/intruder and the contaminants themselves from gaining access to and contact with the casing vent, and thus the aquifer, thus preventing the casing vent security device from being illegally penetrated (e.g., by a person) by contaminants entering the security device. It would also be desirable to provide a casing vent security device that can provide a signal to appropriate authorities when the device has been infiltrated. There is also a need for a casing vent security device that can determine the type of contaminant that has infiltrated the device and be able to provide regular updates regarding the device and its environment via a remote monitoring system. It would be desirable if the device would allow for normal operation of the water well.

BRIEF SUMMARY OF THE INVENTION

Disclosed herein is a casing vent security device comprising: an in-line section in communication with a casing vent, the in-line section having an ambient air passageway for selectively allowing ambient air to pass through the in-line section and into the vent; a plurality of sensors disposed within the in-line section for monitoring the ambient air passing through the in-line section; occlusion means positioned in the in-line section for selectively occluding the passage of ambient air into the vent upon receiving a signal from the sensors; and signaling means for providing information on the plurality of sensors and the vent.

The inventive casing vent security device solves the aforementioned problems and addresses the previously unmet needs in the industry and advantageously provides: 1) a solution that significantly reduces the chance for illegal access to an aquifer, and the well water; 2) a unique device that allows necessary air flow and gas release, while also preventing contaminants from entering the casing vent of the device; 3) a central area or hub for security and monitoring devices to be contained at an aquifer well head site; 4) signaling (e.g., via alarm) to notify authorities of intruder access (e.g., via radio, satellite, phone); 5) a means by which contaminants at a well head site can be identified; 6) a device that is operable with water well applications having an exposed casing vent; 7) a device in which contaminants are minimized. The inventive device permits for normal operation of the water well. The inventive device is ideally easily installed, and maintained.

Various other features, objects and advantages of the present invention will be made apparent from the following detailed description and the drawings.

DETAILED DESCRIPTION OF THE INVENTION

In the following detailed description, references made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural, logical and electrical changes may be made without departing from the spirit and scope of the present invention.

Figure 1:
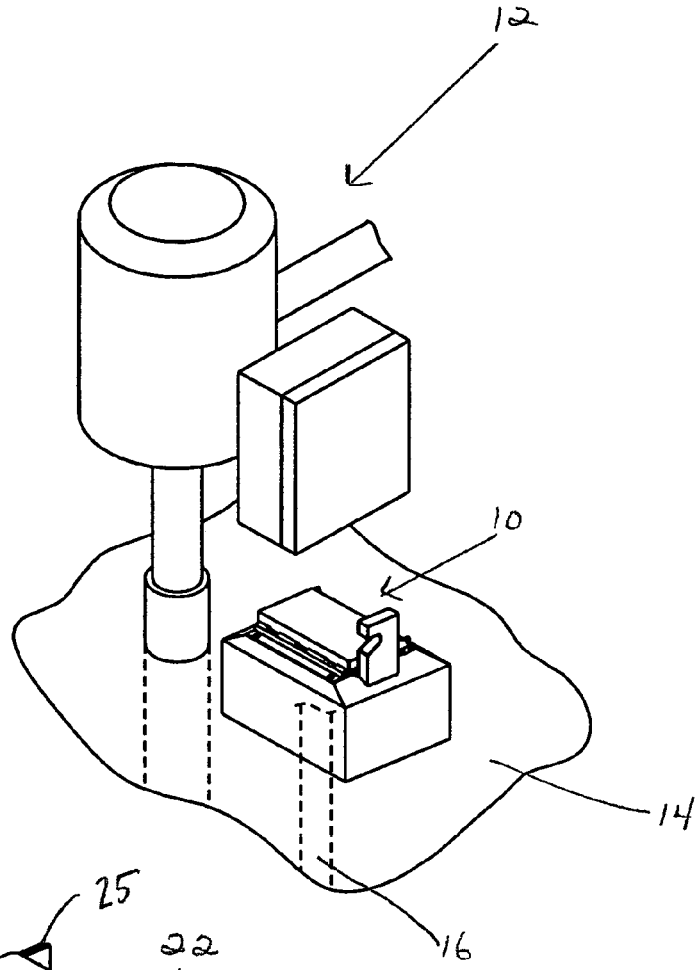
FIG. 1 is a perspective view of an inventive casing vent security device along with its associated aquifer well according to one aspect of the present invention.

FIG. 1 is a perspective view of an inventive casing vent security device 10 along with its associated aquifer well 12 according to one aspect of the present invention. An essential purpose for the device 10 is to prevent intruders from adding contaminants to water within the aquifer well 12. In general, the system is designed to prevent or substantially prevent the addition of contaminants or minimize added contaminants from entering the aquifer well 12. Device 10 accomplishes its intended purpose without eliminating the necessary airflow and gaseous release. For security purposes, device 10 is installed in the ground 14 and secured therein such that it is in communication with casing vent 16 (shown in phantom).

Figure 2:
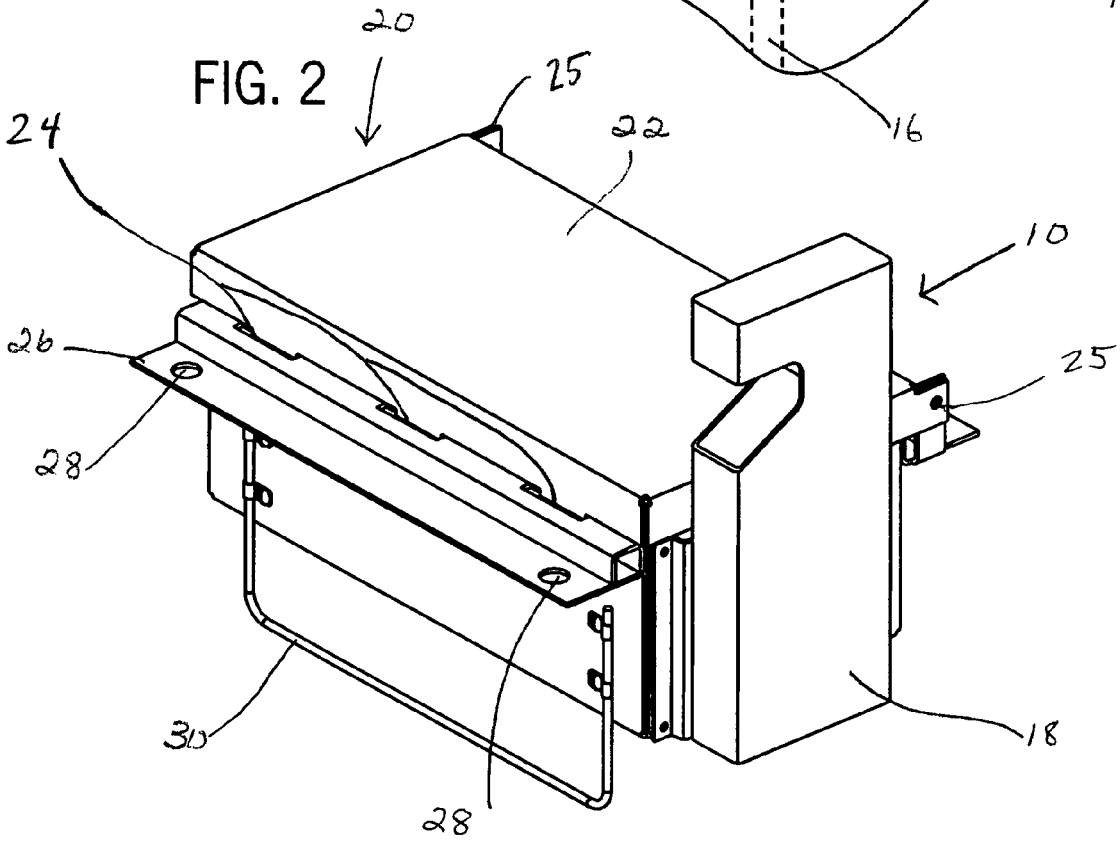
FIG. 2 is a perspective view of the inventive casing vent security device.

FIG. 2 is a perspective view of the inventive casing vent security device 10. The device 10 includes an air vent 18 that serves as a passageway through which ambient air can flow. The vent 18 is connected to the main security device housing 20, which includes cover 22 for housing, protecting and securing, with selected access, the contents of the device. The cover is preferably weather resistant. Cover 22 can be opened for access to internal device components, about hinge(s) 24. Also shown are locking areas 25. Flanges 26, attached to the main housing 20, can be used to secure the device in its intended position, via bolt holes 28. Also shown is stand 30, which provides a means for facilitating shipping and installation of the unit. Stand 30 can be used during installation to adjust device height.

Figure 3:
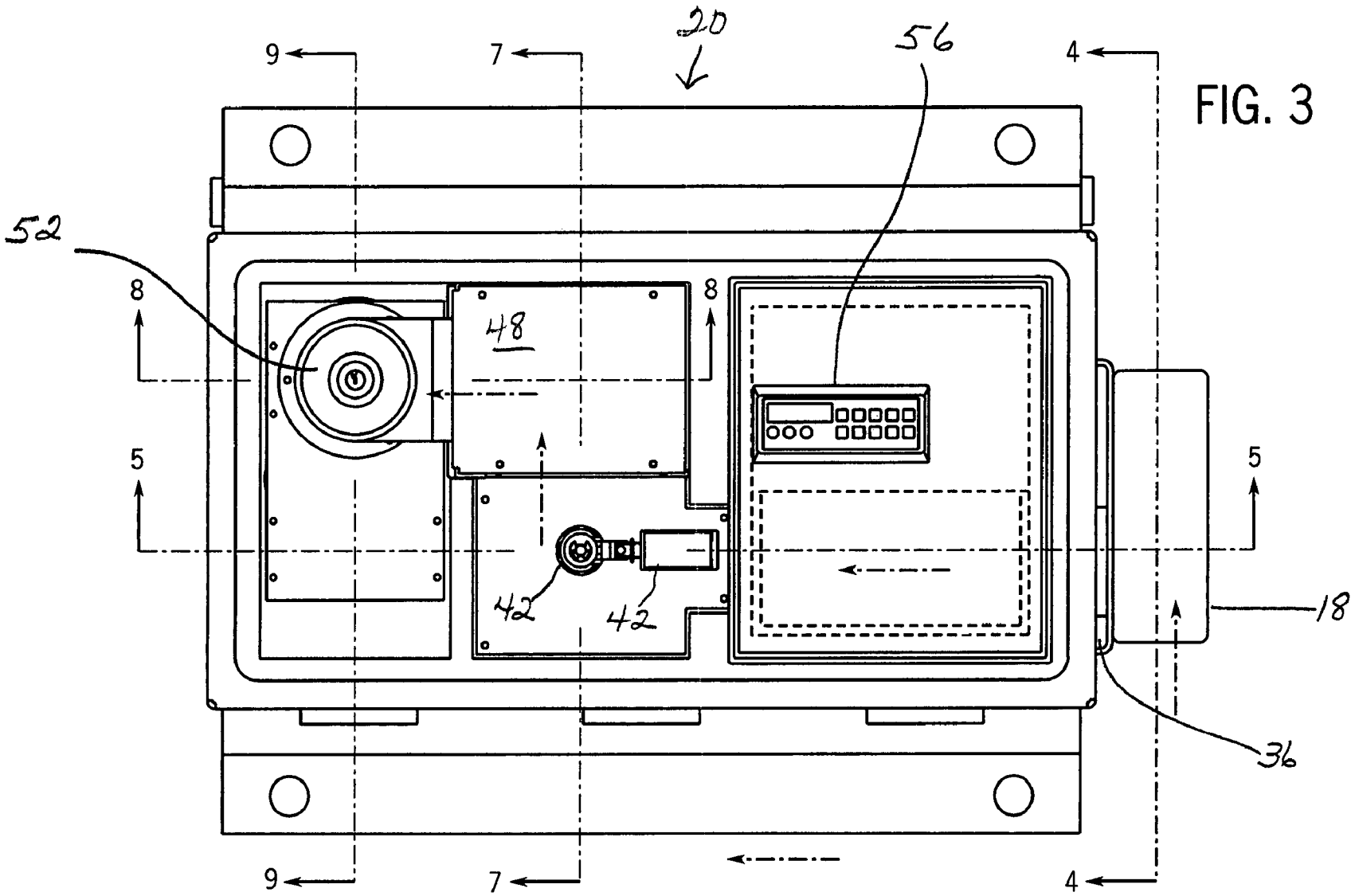
FIG. 3 is a top view of the casing vent security device without a cover so as to expose interior contents of the device.
Figure 4:
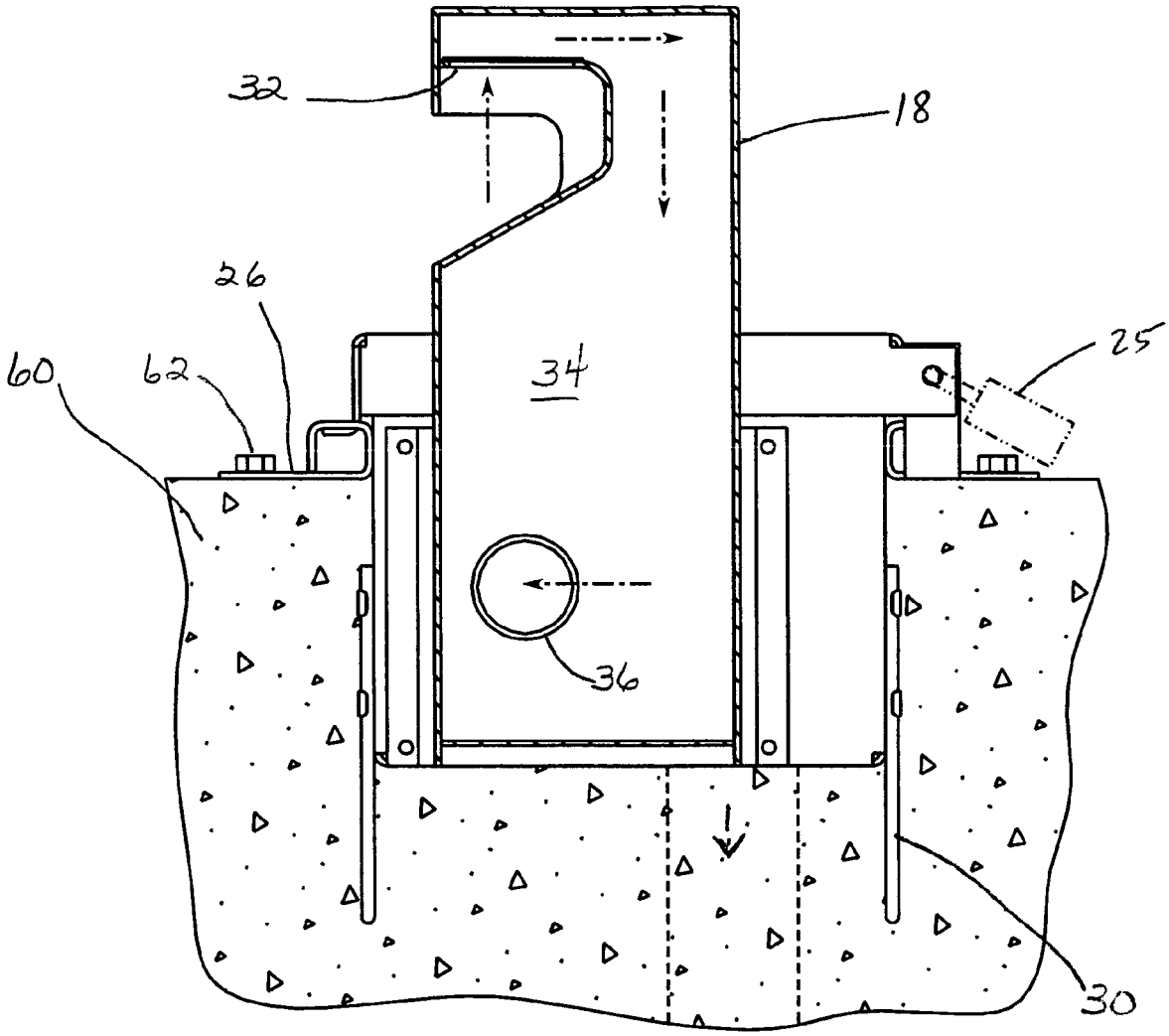
FIG. 4 is a side sectional view of the casing vent security device taken along line 4-4 of FIG. 3.

FIG. 3 is a top view of the casing vent security device 10 without a cover so as to expose interior contents of the device. FIG. 4 is a side sectional view of the casing vent security device taken along line 4-4 of FIG. 3. And FIG. 5 is a front sectional view of the casing vent security device taken along line 5-5 of FIG. 3.

Figure 5:
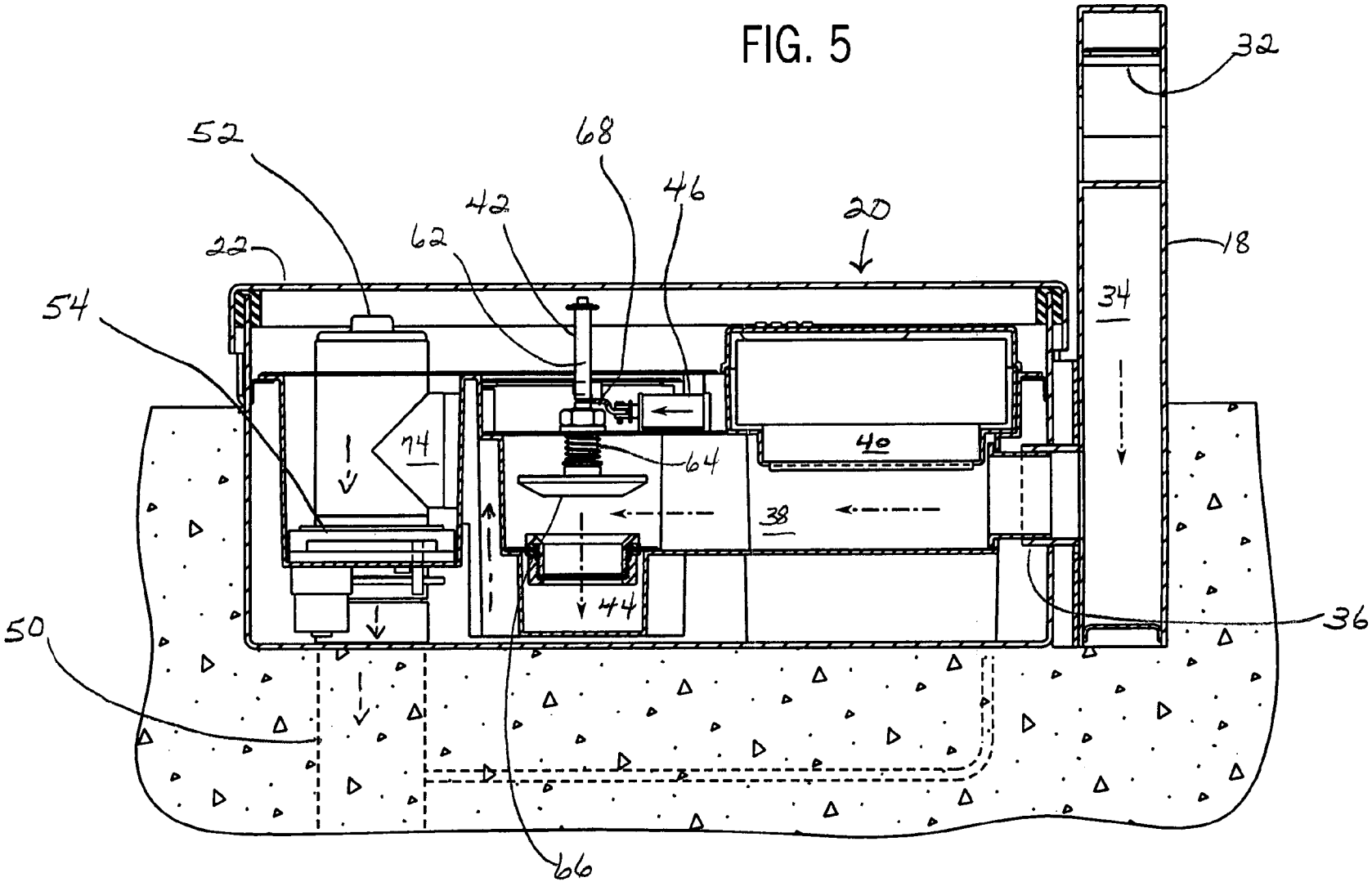
FIG. 5 is a front sectional view of the casing vent security device taken along line 5-5 of FIG. 3.

Referring to FIGS. 3-5, airflow direction is generally indicated by dashed arrows. Air enters through vent screen 32 in vent 18. The vent screen 32 allows for passage of air through the interior 34, but prevents animals and other foreign or undesired objects from entering the vent. Air then enters passageway 36 to enter the main section 20 of the device 10. Air flows into a chamber 38 having sensors 40 positioned so as to, among other things, identify any agents that may have infiltrated the system and, in general, to monitor air quality and trigger seals. Air proceeds to a first valve seal 42 shown in an open position. Seal device 42 selectively allows air to pass into passageway 44. Valve 42 can take any desirable form that provides for a reliable seal, and in this case, includes a rubber seal and solenoid 46 for actuating opening and closing of the valve. Air flows within the housing through branch passageway 48 to encounter casing vent 50 covered by vent access cap 52 and slide door valve 54 covers, while permitting access to, the casing vent. The cap may be similar to a standard gasoline tank cap 52, or other type of secured cap mechanism, and can be opened to check water level quality within the aquifer. Sensors to detect mechanical (e.g., vibrations), chemical, biological and/or nuclear intrusion are controlled by electronic control board 56. The electronic control board 56 is responsible for the electrical control needs of the system, including, driving solenoid 46, electronically controlled movement of the slide door valve 54, and providing general power including powering of the sensors 40. Additional features, such as low power indicators and power and control of communications to remote monitoring locations, can be made a part of electronic control board as well. As shown particularly in FIG. 4, the device 10 can be secured in position via flanges 26 to concrete or other secured material 60, using a securing means, such as bolts, 62. Stand 30 for facilitating positioning of the device 10 is also illustrated.

Figure 7:
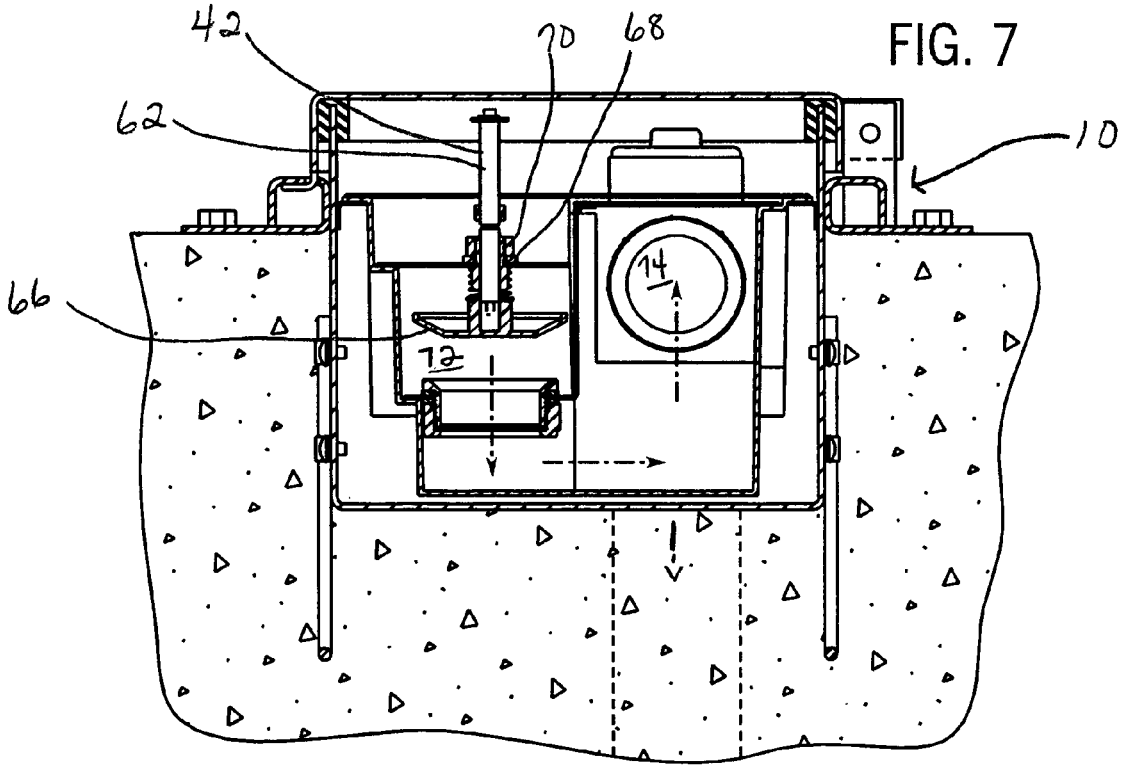
FIG. 7 is a side sectional view of the casing vent security device taken along line 7-7 of FIG. 3.

FIG. 7 is a side sectional view of the casing vent security device taken along line 7-7 of FIG. 3. Referring to FIGS. 5 and 7, the first seal device or occlusion means 42 is shown in open position that permits air to flow through the device 10. The device includes a stem 62, a tensioning spring 64 and a seal or sealing means 66 (e.g., made of rubber). The device 42 is held or positioned in an open position by the engagement of a retaining mechanism 68 which, in this embodiment, comprises a mechanism that is capable of matingly engaging, so as to hold with sufficient force, the stem and the valve in the open position. The retaining mechanism is positioned using guide mechanism 70. When device 42 is in an open position, air can flow, again as indicated by the dashed arrows, via entry port 72 into casing vent entranceway 74 for casing vent 50.

Figure 6:
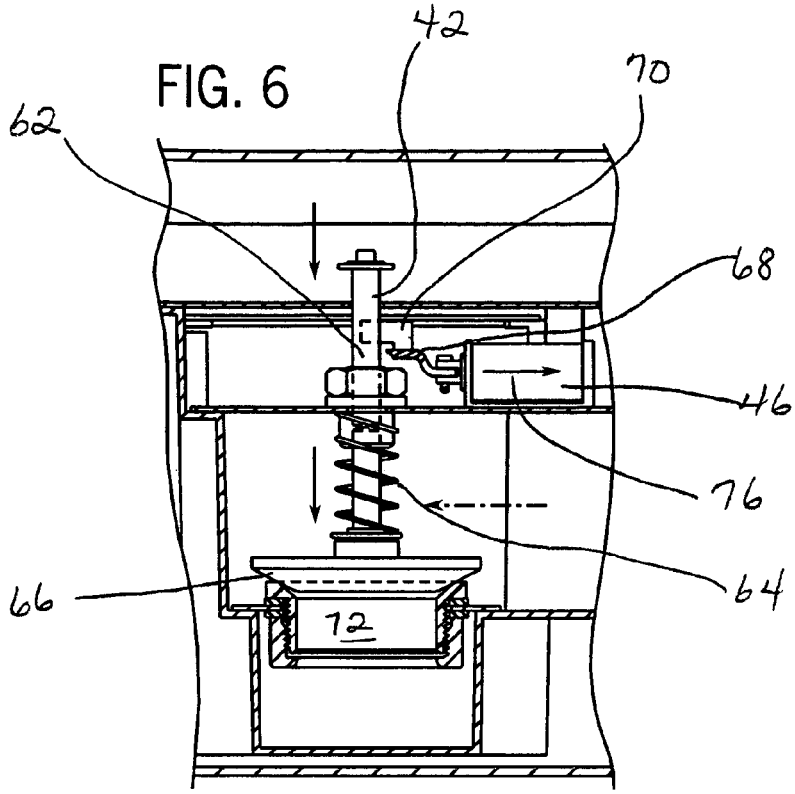
FIG. 6 is an enlarged partial cross-sectional view of a portion of the casing vent security device taken showing movement of a solenoid which engages the seal and prevents access of any contaminants to the aquifer.

FIG. 6 is an enlarged partial cross-sectional view of a portion of the casing vent security device taken showing seal mechanism 42 in a closed position. To accomplish closing, actuating mechanism 46 (e.g., an electromagnetic solenoid), which is connected to retaining mechanism 68, moves in a generally lateral direction indicated arrow 76, to move mechanism 68 from the path of valve stem 62. Once the occlusion means 42 is clear of mechanism 68, the biasing of spring 64 serves to move the sealing device in a downward direction until the seal 66 fully occludes port 72. In this fashion airflow within the device 10 will not continue beyond port 72. This closing process can be considered to be emergency in nature. For example, closing may take place if the sensors (described above) detect mechanical intrusion and/or nuclear, chemical and/or biological contaminants. Alternatively, closing may take place if unauthorized access to the overall device is attempted without proper entry procedures taking place (e.g., the entering of an acceptable access identification code).

Figure 8:
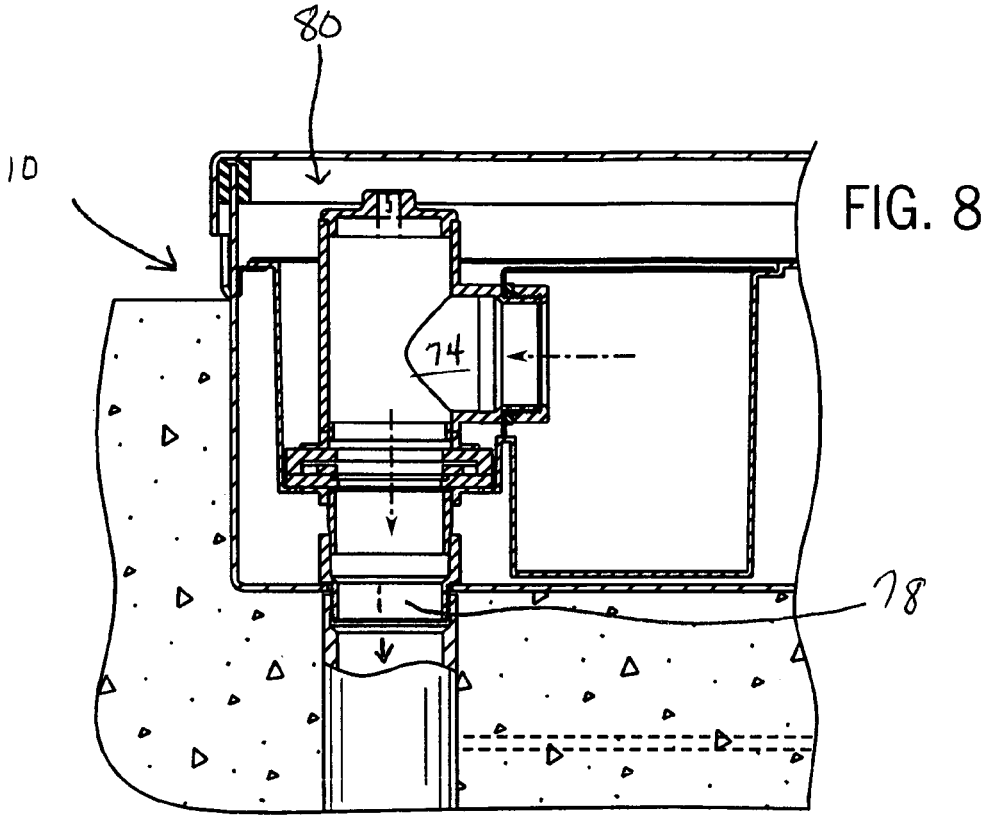
FIG. 8 is a front sectional view of the casing vent security device taken along line 8-8 of FIG. 3.
Figure 9:
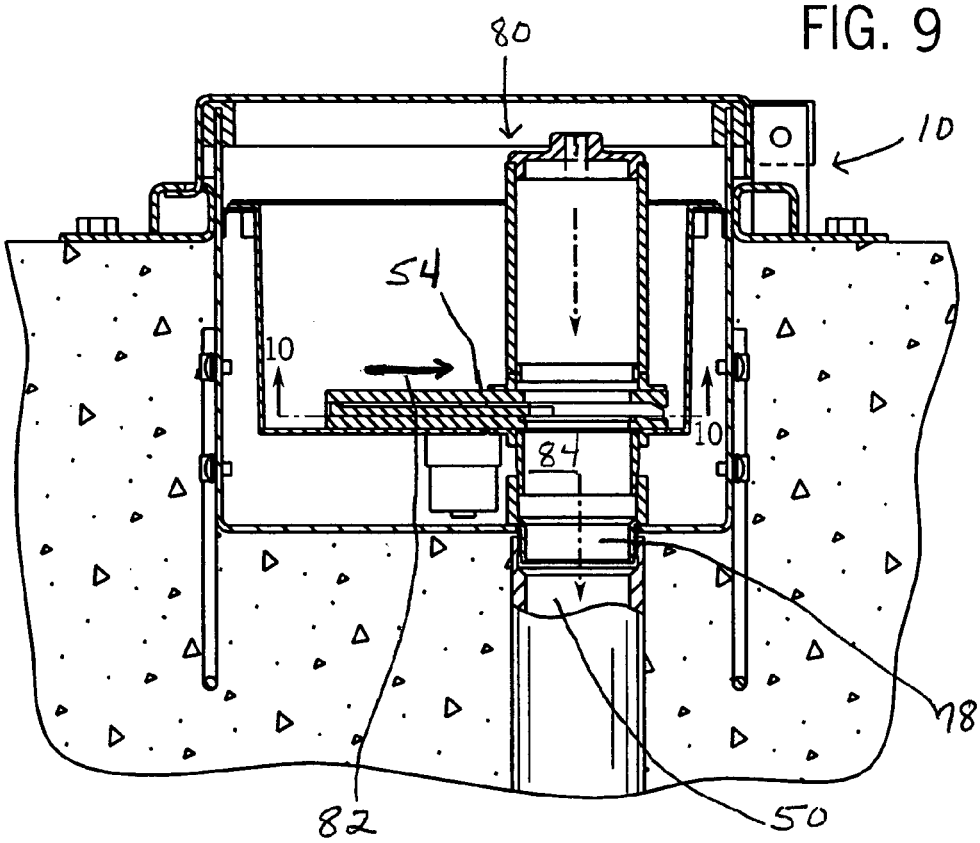
FIG. 9 is a side sectional view of the casing vent security device taken along line 9-9 of FIG. 3.

FIG. 8 is a front sectional view of the casing vent security device taken along line 8-8 of FIG. 3. FIG. 9 is a side sectional view of the casing vent security device taken along line 9-9 of FIG. 3.

FIGS. 7-9 illustrate the final airflow via a second occlusion means or sliding valve sealing mechanism 80 from the device 10 to the aquifer or casing vent 50, and more specifically, via end vent 54. An adapter 78 can be used to facilitate connection between the device 10, the more specifically the valve mechanism 80, and the casing vent 50 by accommodating variations in size of the casing vent. Air flows into the vent entranceway 74, through the valve mechanism 80 and into the casing vent 50 as indicated by dashed arrows. Arrow 82 indicates the direction of the motion of sealing mechanism 80 to occlude the passageway 84 into the casing vent 50, as will be described in greater detail with respect to FIGS. 10-11.

Stated another way, the invention relates to a casing vent security device having an in-line section in communication with a casing vent, the in-line section having an ambient air passageway for selectively allowing ambient air to pass through the in-line section and into the casing vent. The device further comprises a plurality of sensors disposed within the in-line section for monitoring the ambient air passing through the in-line section; occlusion means positioned in the in-line section for selectively occluding the passage of ambient air into the vent casing vent upon receiving a signal from the sensors; and signaling means for providing information on the plurality of sensors and the casing vent. The mechanism for closing and/or opening the sliding valve can be accomplished through micro switches 81, or alternatively, through other means (e.g., using a stall program).

Figure 10:
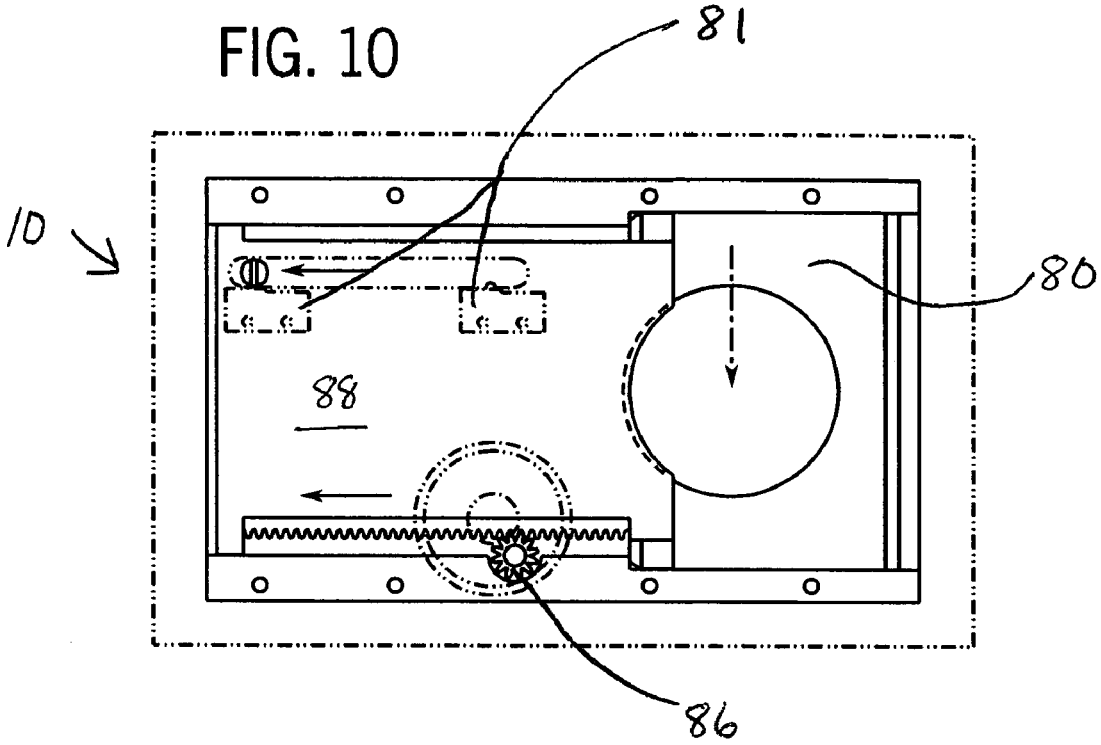
FIG. 10 is cross-sectional view of a portion of the casing vent security device taken along line 10-10 of FIG. 9 showing a seal in an open position.
Figure 11:
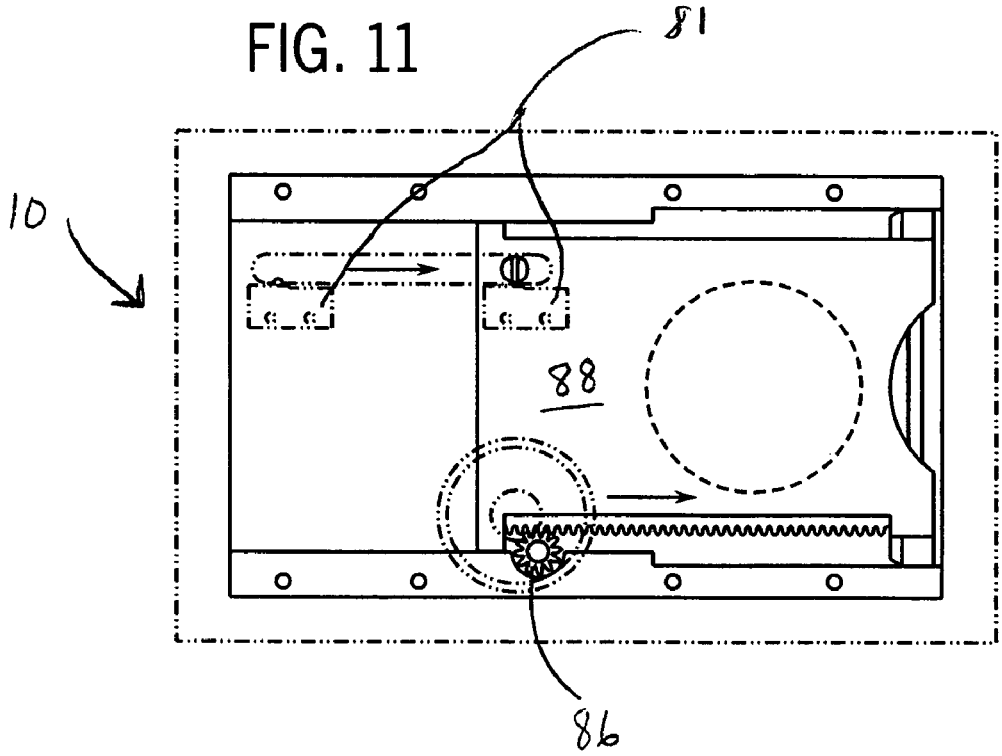
FIG. 11 is cross-sectional view of a portion of the casing vent security device similar to that of FIG. 10 showing a seal in a closed position.

FIG. 10 is cross-sectional view of a portion of the casing vent security device taken along line 10-10 of FIG. 9 showing second occlusion means 80 in an open position. FIG. 11 is cross-sectional view of a portion of the casing vent security device similar to that of FIG. 10 showing the second occlusion means in a closed position. The device 10 incorporates gearing 86 in operation association with motor means (shown in phantom) to drive plate 88 to open or close in sliding fashion. Here, as before, to protect the integrity of the aquifer, several safety features can be included. For example, the valve 80 can be closed upon trigger of a sensor(s) sensing, for example, mechanical disruption and/or nuclear, biological and/or chemical contaminants. The valve can also be closed upon improper human or other access or tampering (e.g., without entering of an appropriate access code). In one embodiment, the valve can only be opened using a password or code entered into the system.

As used herein, the term "sensors" can include a variety of sensing devices and should not be construed in limiting sense. Exemplary sensors can include: 1) environmental or ambient air sensing mechanisms (e.g., to measure temperature, etc.); 2) Geiger sensors; 3) vibration sensors; 4) agent or nuclear, chemical and/or biological contaminant sensors; and 5) air quality sensors. Sensors are strategically located in the Product. For the vibration sensor, if a specified intensity of force is applied to the casing vent security device, the vibration sensor will activate and can cause both valves to trigger. The Geiger sensor can detect any radioactive contaminates that would enter the casing vent security device, and upon detection, both valves can seal. Additionally, upon undesired solids or liquids entering the system, solid or liquid sensors can ensure that one or both valves will trigger. Additional Sensors (e.g., tilt, monitoring, photo ionization, etc.) can be added 'a la carte' to meet the customer's specific needs.

Figure 12:
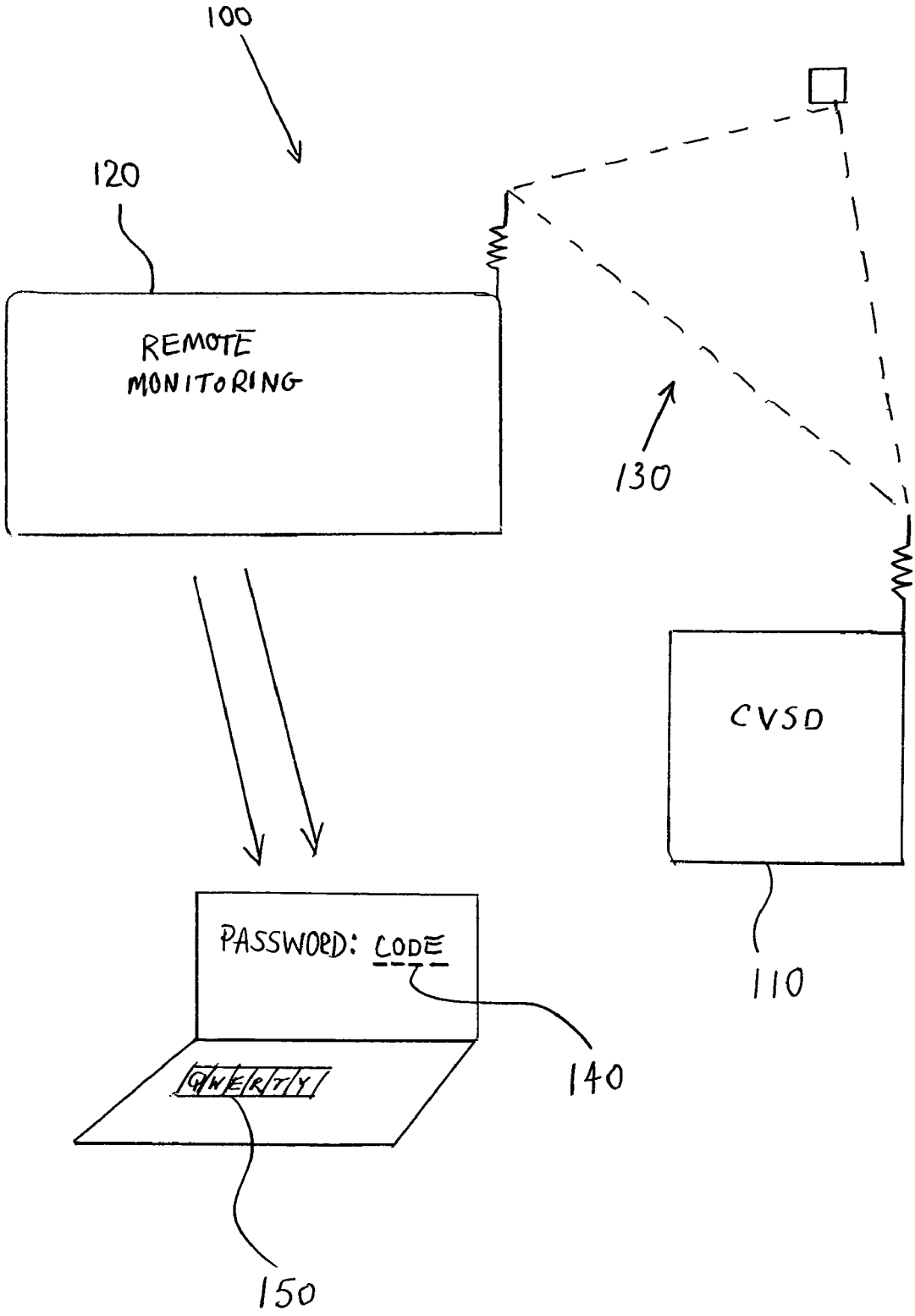
FIG. 12 is a schematic diagram of a remote monitoring system for use with the casing vent security device of the present invention.

FIG. 12 illustrates a system 100 for use in remotely monitoring and controlling status or conditions of the inventive casing vent security device 110. A number of security features can be incorporated to both prevent and provide notice in the event of a breach of the device. If the device is physically opened (e.g., the cover panel is opened), the second valve (described above) can automatically be shut. A message can be sent to a third party, generally referred to as the concept of "remote monitoring" and identified by the number 120. In this fashion, the third party can be notified that a breach has occurred. Such notice can be made via, for example, radio or satellite, as indicated by number 130. The second valve could then be reopened upon the entry of a correct code 140 that can be entered remotely via a keypad 150. Such entry can be timed, for example, if no code is entered within 'X' seconds, an alarm can be triggered to go off until the correct code is entered. Communications to remote location can include "low battery", "loss of power", "motor breakdown", "sensor breakdown" and/or or other unit malfunction information.

It is contemplated that the unit can be powered by local electric power (e.g., 110 or 220V) along with an internal rechargeable power source. Alternatively, the unit can be fitted for solar energy generation. Any loss of power, regardless of the type of power source, will result in both valves being triggered to close and communications to the remote monitoring party with such communication being powered by the rechargeable power source. However, the triggering can and usually will be delayed. More specifically, if there is a power outage, a communication (e.g., "POWER IS OUT") will be sent to a monitoring location and the unit will continue to be powered by batteries. After a period of time (i.e., a time delay), seals can be triggered and a communication (e.g., "LOW BATTERY POWER") will be sent to the remote monitoring location.

Because the casing vent security device 10 provides a convenient and secure access point to the aquifer, the present invention can be used to test the depth of the aquifer's water level. The basic procedure is to lower a probe (not shown) into the well to test the depth. More specifically, the method includes unlocking and opening the device cover 22; entering a code to disengage the valves 42 and 54; unlocking the cap 52 to the second valve 54; checking the aquifer well depth using the probe; locking the second valve 54; re-engaging the solenoid 46 on the first valve 42; and closing and locking the cover 22.

The invention also includes a method of securitizing a casing vent security device, the method comprising: sensing ambient air passing within a passageway within the device; and monitoring physical characteristics of the ambient air. The sensing step can include sensing at least one of: chemical, biological, radioactive, gas phase, liquid phase and solid phase contaminants. The monitoring step can further include monitoring for a physical breach of the device, and if so, occluding passing of the ambient air within the passageway of the device. The occluding step can include plunging a valve into a closed position. The occluding step can still further include sliding at least a portion of a valve into a closed position. And the sliding step can further include driving, using a motor, the at least a portion of the valve into the closed position.

Figure 13:
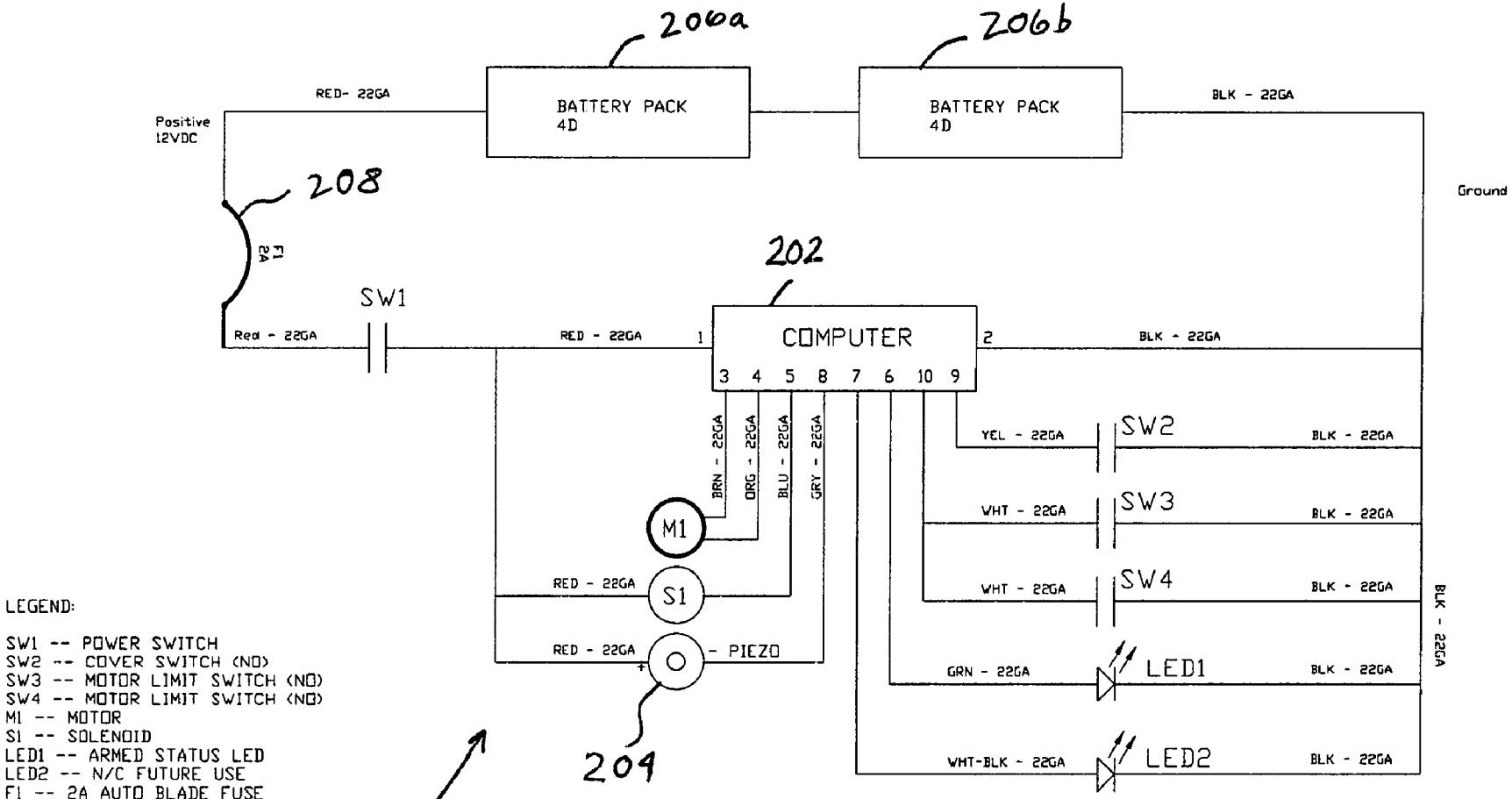
FIG. 13 is a schematic illustration of circuitry for use with the inventive casing vent security device.

FIG. 13 is a schematic illustration of circuitry 200 for use with the inventive casing vent security device computer 202. Computer 202 is responsible for, and is electrically connected to, operating motor M1, solenoid S1, and piezo sensor 204. Power supplied by battery packs 206*a-b* with current limited by fuse 208. Various switches are included for switching power SW1, limiting the motor SW3-4. And cover switch SW2 can be provided. Indicator lights, such as LED 1 and LED 2 can be added to provide a visual alarm status and are operated by computer 202. During initial installation of computer 202, it will be necessary to configure motor M1 duty cycles and solenoid S1 duty cycles, among other set-up information required. To accomplish this, a personal computer with a typical Windows® installation with a communication port, for example a nine pin RS-232 port connection can be used. By using a serial cable and plugging into computer 202, and running a, for example, a Windows® HyperTerminal program, a personal computer (now tied into computer 202) can communicate with one another and perform any set-up and configuration settings in order to properly set computer 202.

While the invention has been described with reference to preferred embodiments, those skilled in the art will appreciate that certain substitutions, alternations and omissions may be made without departing from the spirit of the invention. For example, upon triggering any of the sensors one or both valves maybe closed. Valves may be manually reset and/or automatically re-opened. If an alarm is triggered, the duration of the alarm may vary. And notification to those remotely monitoring the device may be sent over a variety of mediums. Moreover, the specific or precise geometry of the passageway(s) within the interior of the device can be varied to convenience provided that the essential purpose(s) of the invention are maintained. Therefore many variations are of the tortuous passageway are contemplated, although not specifically exemplified, and considered within the scope of the present invention.

What is claimed is:

1. A casing vent security device adapted for use with a casing vent, such as a well casing vent, comprising:

an in-line section in communication with a casing vent, the in-line section having an ambient air passageway for selectively allowing ambient air to pass through the in-line section and into the vent;

a plurality of sensors disposed within the in-line section for monitoring the ambient air passing through the in-line section;

occlusion means positioned in the in-line section for selectively occluding the passage of ambient air into the vent upon receiving a signal from the sensors; and signaling means for providing information on the plurality of sensors and the vent wherein the occlusion means includes a first plunger valve and a second slide valve.

2. The device of claim 1 wherein the sensors are capable of sensing at least one of: mechanical, chemical, biological, radioactive, gas phase, liquid phase and solid phase contaminants.

3. The device of claim 1 further including an adapter unit for adapting the casing vent security device retrofittingly to an existing vent.

4. The device of claim 1 further including a housing for encompassing at least the in-line section.

5. The device of claim 1 in combination with a remote monitoring system for remotely monitoring device activities.

6. The device of claim 1 wherein a signal indicates potential contamination of the ambient air passing through the in-line section.

7. The device of claim 1 further comprising a solenoid for actuating at least one of the valves.

8. A casing vent security device adapted for use with a casing vent, such as a well casing vent, comprising:

an in-line section in communication with a casing vent, the in-line section having an ambient air passageway for selectively allowing ambient air to pass through the in-line section and into the vent;

a plurality of sensors disposed within the in-line section for monitoring the ambient air passing through the in-line section;

a first plunger valve and a second slide valve, the first valve positioned in the in-line section and the second valve positioned downstream of the first valve, the valves for selectively occluding the passage of ambient air into the vent upon receiving a signal from the sensors; and signaling means for providing information on the plurality of sensors and the vent.

9. The device of claim 8 wherein the first valve is spring actuated.

10. The device of claim 8 wherein the second valve is in operational association with motor means to open or close the second valve in sliding fashion.

* * * * *